United States Patent [19]

Engel

[11] Patent Number: 4,753,089

[45] Date of Patent: Jun. 28, 1988

[54] WATER-REMOVAL PRESS FOR TEXTILES

[76] Inventor: Gerhard Engel, Weststrasse 17, 7129 Gueglingen, Fed. Rep. of Germany

[21] Appl. No.: 832,579

[22] Filed: Feb. 24, 1986

[30] Foreign Application Priority Data

Feb. 23, 1985 [DE] Fed. Rep. of Germany ..... 3506382

[51] Int. Cl.[4] ..... D06F 47/06

[52] U.S. Cl. ..... 68/242; 100/211

[58] Field of Search ..... 100/211, 212; 68/241, 68/242; 92/248, 249

[56] References Cited

U.S. PATENT DOCUMENTS

| | | | |
|---|---|---|---|
| 2,336,428 | 12/1943 | Watson | 68/242 |
| 2,372,753 | 4/1945 | Watson | 68/242 |
| 2,685,189 | 8/1954 | Watson | 68/242 |
| 2,817,228 | 12/1957 | Koplin | 68/242 |
| 2,832,209 | 4/1958 | Sibbald | 68/242 |
| 4,180,995 | 1/1980 | Meyer | 100/211 X |
| 4,452,056 | 6/1984 | Files | 68/242 |
| 4,574,599 | 3/1986 | Pellerin | 100/211 X |

FOREIGN PATENT DOCUMENTS

| | | | |
|---|---|---|---|
| 0060420 | 9/1982 | European Pat. Off. . | |
| 2846760 | 5/1979 | Fed. Rep. of Germany | 68/241 |
| 2801200 | 7/1979 | Fed. Rep. of Germany . | |
| 8202643.2 | 6/1982 | Fed. Rep. of Germany . | |
| 2852923 | 6/1983 | Fed. Rep. of Germany . | |
| 2440818 | 10/1983 | Fed. Rep. of Germany . | |
| 3307229 | 9/1984 | Fed. Rep. of Germany | 68/242 |
| 3312808 | 9/1984 | Fed. Rep. of Germany . | |

*Primary Examiner*—Harvey C. Hornsby
*Assistant Examiner*—Frankie L. Stinson
*Attorney, Agent, or Firm*—Foley & Lardner, Schwartz, Jeffery, Schwaab, Mack, Blumenthal & Evans

[57] ABSTRACT

Disclosed is a water-removal press having, in a machine framework, a press base with discharge openings, a circular-cylindrical filling frame with end faces open on both sides, and a press piston. The filling frame and the press piston are displaceably guided perpendicularly on common guides and are vertically adjustable in each case by means of a lifting device. The press piston has a rigid piston body and a pot-shaped diaphragm enveloping the piston body from below. In the non-operating position, the outside diameter of the press piston is smaller than the clearance width of the filling frame. During the press operation, the press piston plunges into the filling frame. When a pressure fluid is applied to the inner side of the pot-shaped diaphragm, the latter sits against the periphery on the filling frame and expands at the end face down to the washing mass located below it to press out the latter. After the pressing, the pot-shaped diaphragm is relieved, and first the filling frame and then the press piston are raised, so that the washing mass is exposed.

14 Claims, 8 Drawing Sheets

WATER-REMOVAL PRESS FOR TEXTILES

BACKGROUND OF THE INVENTION

The present invention relates to a water-removal press, and specifically to a water-removal press which uniformly presses the water-containing mass across its topography.

Textiles which are freshly washed and which come out of an automatically working and automatically unloading washing machine still contain a considerable quantity of water from the final washing operation or rinsing operation. This water must first be removed before the textiles can be conveyed to further treatment stations, for example, driers and/or mangle stations. Water-removal presses are usually used for removing the water from these textiles.

A known water-removal press (German Patent Specification No. 2,852,923) has a press table having a perforated plate and a collecting basket or filling frame in the form of a circular cylinder which is open on both sides. This filling frame is guided on a perpendicularly aligned guide and is moved into various vertical positions by means of a lifting device. In the case of the same plan form, the filling frame has a clearance width which is slightly larger than the outside dimensions of the press table. The filling frame can, therefore, be put over the press table and lowered relative to the latter until its upper edge is at about the same height as the press table upper side. On its top edge, the filling frame is provided with an outwardly protruding collar, the upper end face of which, i.e., the end facing away from the filling frame, is made in the shape of a truncated cone, and, in fact, with an obtuse cone angle. On the underside, the collar has a flat end face as a stop surface, by means of which the filling frame, in its lowered position, is supported on a support plate annularly enclosing the press table. Moreover, the water-removal press has a press piston which is likewise guided in alignment with the filling frame on a perpendicular guide and which can be moved into various vertical positions by means of an independent lifting device. This press piston has a rigid piston body in the form of a downwardly open bell, the opening of which is closed by a rubber-elastic diaphragm. The bell edge has the same plan projection as the collar of the filling frame and is made in the same manner, i.e., in the shape of a truncated cone.

The edge of the diaphragm sits against this bell edge and is connected there to the piston body by means of a metal clamping ring.

For removing water from textiles, the filling frame is moved into a vertical position in which its upper edge is above the press table to the extent that its lower edge reaches just slightly below the upper edge of the press table. When the press piston is raised, the wet textiles are brought, i.e., flushed, into the filling frame via a chute. The free water between the textiles runs off through the discharge openings in the press table and through the annular gap between the press table and the filling frame. The press piston, together with its bell edge, is lowered onto the collar of the filling frame.

Since this water-removal press works automatically just like the washing machine connected in front of it, textile parts which have been left behind on the comparatively slightly inclined collar of the filling frame during the flushing-in step can easily become jammed afterwards during the lowering movement between the metal collar of the filling frame and the metal clamping ring on the press piston and at least creased, if not quite damaged.

After the bell edge is placed on the collar of the filling frame, both parts are lowered further together relative to the press table until the collar sits on the supporting plate. In this vertical position, the upper edge of the filling frame is located approximately at the level of the upper edge of the press table. During this lowering movement, the textiles are held back from the press table. At the same time, the diaphragm comes into contact with the washing mass and is, first of all, extended into the inner space of the bell-shaped piston body. A pressure fluid is pressed into the intermediate space between the diaphragm and the bell base, by means of which the diaphragm compresses the washing mass on the press table, is largely pressing out the water from the washing mass. The removed water then runs off through the discharge openings in the press table.

The press piston is raised after the press operation is complete. The filling frame must likewise first be raised so that the pressed washing mass can be pushed away laterally from the press table. However, since the washing mass has not only been compressed vertically by the press operation, but, at the same time, has also been extended outwards, the washing mass sits against the inner wall of the filling frame with a considerable expanding force. The washing mass is often raised along with the filling frame when the latter is being raised. It can then only be removed from the filling frame with great difficulty. Since the water-removal press is part of a fully automatic washing line, this behavior of the washing mass leads to the automatic working sequence being disturbed very frequently. The operating personnel then have to intervene manually to restart the working sequence.

Another known water-removal press has a press base which is perforated. A filling frame in the form of a circular-cylindrical section open on both sides is arranged above this press base. The filling frame is displaceably guided on a perpendicularly aligned guide and can be lowered onto the press base and adjusted in various vertical positions by means of a lifting device. A press piston is guided in a vertically adjustable manner in alignment with the filling frame by means of a piston drive having a perpendicularly path of motion. The press piston has a rigid piston plate, on the underside of which is arranged a press pad or press cushion which has a circular-cylindrical edge part and a base part. The press cushion is filled with water which is pressureless in the normal condition, the volume of which remains unchanged.

At the start of the press operation, the press cushion in this water-removal press initially plunges only partially into the filling frame. While the press cushion sits against the washing mass, the internal pressure in the press cushion is increased. Consequently, the press cushion edge-part section still located outside the filling frame is extended radially. Moreover, in the case of a washing mass having a very variable filling level, the press cushion can be thrust up on one side, so that the radial expansion is intensified at this location. As a result of this press cushion dislocation on one side, individual textile parts can even be pushed out on the raised side.

During the further downward movement of the press piston and the press cushion, the expanded edge part of the press cushion, and therefore the edge part sitting on the edge of the filling frame, must be radially compressed while overcoming considerable frictional forces and, at the same time, be pressed axially into the filling frame. Even if the edge part has completely entered the filling frame, this frictional force is maintained during the further lowering movement of the press piston, because the internal pressure of the press cushion still acts radially on the edge part.

In the case of the frequently occurring, non-uniform filling level of the material to be pressed, only the portion with the higher filling level is correctly pressed out. On the other hand, the areas of the washing mass with an initially lower filling level are only inadequately pressed out.

In this press, the piston plate above the press cushion must be adapted with a very close fit to the clearance width of the filling frame, so that, when the press cushion is plunging into the filling frame, an annular gap does not remain open between the filling frame and the edge of the piston plate, into which annular gap the edge part of the press cushion could be pushed by the high internal pressure, which would be damaging for the press cushion, especially its edge part. On the other hand, however, this close fit between the piston plate and the filling frame has the great disadvantage that those items of washing which are left behind by chance on the edge of the filling frame or which have been pushed away towards the edge area during the press operation could become jammed between the metal piston plate and the metal filling frame and in so doing, could even be sheared off.

SUMMARY OF THE INVENTION

A primary object of the invention, therefore, is to create a water-removal press for textiles, by means of which automatic operation, which is as trouble-free as can be, is possible.

Another object of the present invention is to provide a water-removal press for textiles which achieves a good water-removal result which is as uniform as possible.

Still another object of the present invention is to provide a water-removal press for textiles which achieves the above-noted water-removal, while treating the textiles with the greatest care possible.

Therefore, in accordance with the present invention, there is provided a water-removal press for textiles comprising a machine framework, a press base which includes a plurality of discharge openings, a circular-cylindrical filling frame, the filling frame being open at both end faces and displaceably guided on perpendicularly aligned guides and capable of being lowered onto the press base and vertically positioned by means of a lifting device, a press piston comprising a circular, rigid piston body, a pot-shaped elastic body fixed to the piston body along an edge area, and an intermediate space between the piston body and the elastic body which can be filled with a fluid, the piston being displaceably guided in alignment with the filling frame by means of a perpendicularly aligned guide and vertically positionable by means of a lifting device, wherein the elastic body comprises a pot-shaped diaphragm which includes a base part, a circular-cylindrical collar part which adjoins the base part without transition, the base part being flat in the stress-free condition, and an inwardly directed fastening bead integrally formed on the open edge of the collar part, the lower edge of the fastening bead being adapted to seat on a seating surface of the piston body, a clamping ring, arranged on the side of the fastening bead facing away from the base part, which includes a seating surface contacting the fastening bead, the clamping ring being connected to the piston body in the axial direction, a filling and emptying means which includes a delivery pump and a pressure pump for filling and emptying the intermediate space, wherein the collar part of the diaphragm, in the stress-free condition, has an outside diameter smaller than the clearance width of the filling frame, the peripheral surface between the end-face seating surface of the fastening bead and its free end face is shorter than the axial clearance distance between the base part and the fastening bead, and the outside diameter of the peripheral surface of the piston body is smaller than the clearance width, measured in the same plane, of the collar part, and wherein the free end face of the piston body is at least partially hollow relative to a reference plane in contact with the free end face.

Because the piston, with its diaphragm, has a certain undersize in the radial direction relative to the filling frame, the piston can be guided into the filling frame without frictional forces developing until it has reached the vertical position corresponding to its press position, in which it is then held firmly. Because the piston is also enclosed on its peripheral surface by the diaphragm, that is by the collar part of the diaphragm, which has the same elastic resilience as the base part, this outer skin of the piston, when the intermediate space between it and the piston body is acted upon by a pressure medium, can expand radially until it sits against the filling frame. From this operating condition, the press space between the press base, the filling frame and the piston is tightly sealed outward and upward, by which means the water pressed out of the textiles can only escape downward through the discharge openings of the press base. Because the diaphragm is freely movable outside its fastening bead relative to the piston body, it is able to move away from the piston body onto the textiles lying below it when an overpressure acts upon its inner side, and can press these textiles against the press base with an overall uniform contact pressure. As a result of this free expansion possibility, the diaphragm can then fill the entire hollow space of the filling frame itself, even if only a few textiles are present. This also applies to a non-uniform filling of the filling frame with filling levels of the textiles which deviate considerably from one another. Even then, the press result is, to the greatest extent, independent of the filling quantity and the filling level at each part of the base. Because the collar part of the diaphragm has a clearance width which is slightly larger than the diameter of the peripheral surface of the piston body, and because the end face of the piston body is at least partially hollow relative to a reference plane which is in contact against it, if a vacuum is produced in the intermediate space between the diaphragm and the piston body relative to the environmental pressure, the base part of the diaphragm is then drawn into the hollow space of the end face of the piston body and at the same time the collar part of the diaphragm is reduced in its outside diameter and placed in contact against the peripheral surface of the piston body. During this procedure, the collar part of the diaphragm is lifted inward from the inner surface of the wall of the filling frame. Consequently, the filling frame can, in turn, be raised relative to the piston, which continues to be firmly held in its press position, without any frictional forces appearing between the piston and the filling frame. During this raising of the filling frame, the washing mass is held back from the piston if it should ever sit against the inner wall of the filling frame as a result of the press operation. If the piston has then also been raised, the washing mass lies freely accessible on the press base and can then be easily conveyed further by a slide.

If any textile parts should be left behind on the edge of the filling frame and should partly hang down into the inner space of the filling frame, as a result of which the parts can extend between the peripheral wall of the piston and the filling frame, then, when the piston plunges into the filling frame, these parts are, if need be, compressed between the metal filling frame and the rubber-elastic collar part of the diaphragm during the subsequent press operation, with the water being removed therefrom. But because of the resilience of the outer skin of the piston, these textile parts do not sustain any damage.

The undersize between the peripheral wall of the piston body and the clearance width of the collar part of the diaphragm facilitates the fitting of the diaphragm. In particular, this construction facilitates placing of the fastening bead over the peripheral surface of the piston body. Moreover, the fastening bead can consequently receive a greater radial extension, which is useful for a greater radial elasticity of the collar part of the diaphragm, as a result of which the sealing effect of the collar part is, in turn, improved in the upward direction.

In a further embodiment of the water-removal press according to the present invention, the cross-sectional shape of the fastening bead of the diaphragm increases in height in the direction inward of the peripheral edge of the piston body. Preferably, the fastening bead has a one-sided or double-sided dovetail cross-section. Furthermore, the seating surfaces of the fastening bead and the piston body are adapted to the cross-sectional shape of the fastening bead in the stress-free condition. Also provided to the clamping ring is a supporting edge which is arranged around the outer periphery of the seating surface of the clamping ring and is integrally formed with the upper edge of the diaphragm. The outside diameter of the supporting edge of the fastening bead is smaller than the clearance width of the filling frame and also the outside diameter of the collar part of the diaphragm.

The sealing effect between the fastening bead and the adjacent parts of the piston body is improved by the wedge-shaped cross-sectional form of the fastening bead when the inner side of the diaphragm is acted upon by an overpressure, thus pressing the collar part of the diaphragm outwardly. Consequently, the elastic reductions in the cross-section of the fastening bead are compensated without having to fear leakages and, therefore, pressure losses of the pressure medium.

In a further embodiment of the water-removal press, the lifting device for the press piston is relieved of the considerable reaction forces which appear during the press operation between, on the one hand, the diaphragm supported on the press base and, on the other hand, the piston body. These reaction forces are directly transmitted onto the machine framework by the locking device. Consequently, the lifting device can be operated with a considerably lower pressure of the pressure medium. For all these reasons, the lifting device, as well as the parts interacting therewith, can be built considerably lighter and, therefore, also considerably cheaper.

In a still further embodiment of the water-removal press, digital pressure regulation for given pressure levels of the working medium is created in the cavity on the inner side of the diaphragm. By this means, the pressure can be set to the respective highest tolerable value for different textiles and can be very reliably followed. The comparator circuit is connected by the vibrator at regular small time intervals, on the one hand to the pressure sensor, and on the other hand to the selector device. The actual pressure measured by the pressur sensor is thereby compared with the reference pressure set at the selector device, and when the reference pressure is exceeded the actual pressure is changed to the desired pressure value by opening for a short period of time the value or pressure is exceeded the actual pressure is changed to the desired group of valves of the magnetic valves present whose throttle points, alone or in common, bring about the required pressure drop in order to bring the pressure in the connecting duct and in the interior space of the diaphragm to the reference pressure and to maintain this level.

In yet another embodiment of the water removal press, the press-out washing mass can be pushed away carefully, and with the minimum possible space requirement, from the region of the press and onto a conveyor, to be moved to the succeeding treatment stations. The speed of displacement and the displacement force can be very easily set, according to the requirements of the washing mass and the individual pieces of washing, using the working pressure of the working medium via the pneumatic piston drive.

BRIEF DESCRIPTION OF THE DRAWINGS

The invention is described in greater detail below with reference to an illustrative embodiment shown in the drawing, in which.

DETAILED DESCRIPTION OF THE PREFERRED EMBODIMENTS

Figure 2:
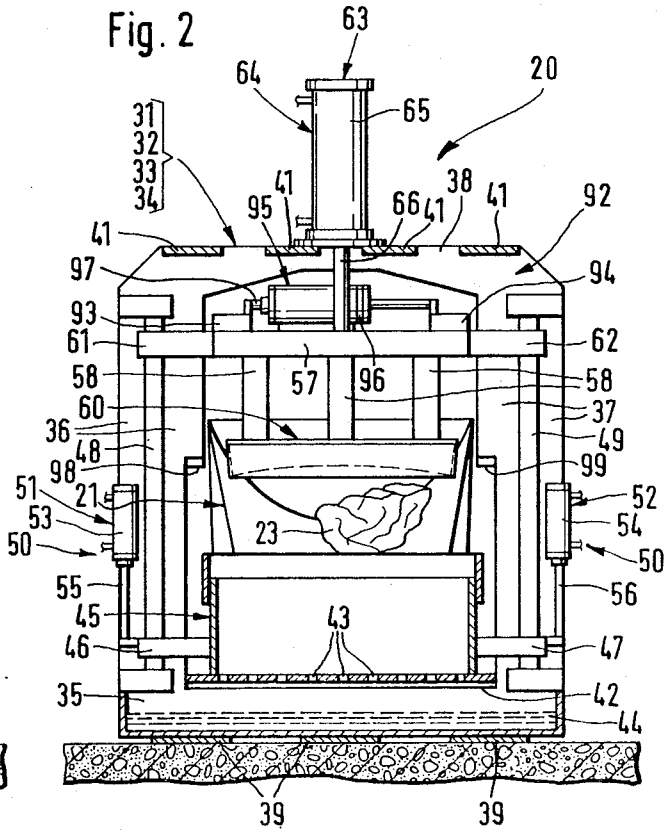
FIG. 2 shows a vertical section of the water-removal press in the transverse direction in a first operating condition of the parts.
Figure 1:
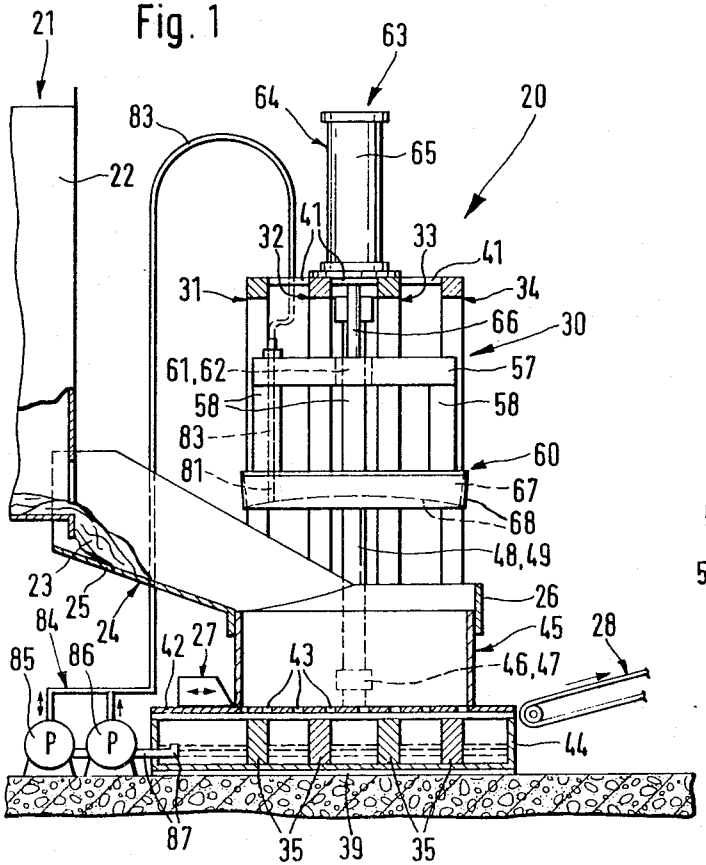
FIG. 1 shows a vertical section of the water-removal press in the longitudinal direction in a first operating condition of the parts.
Figure 10:
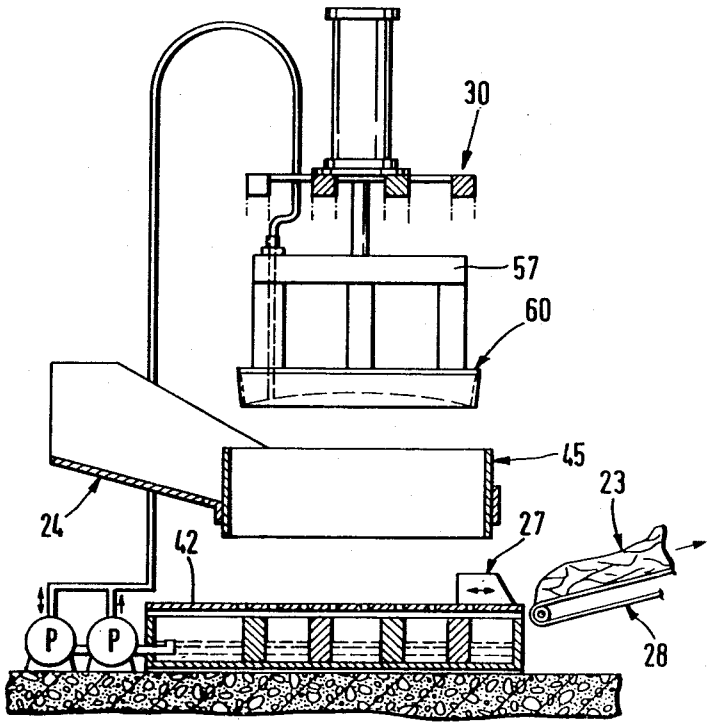
FIG. 10 shows a vertical section, similar to FIG. 1, in a seventh operating condition.

From FIGS. 1 and 2 can be seen an automatically working water-removal press 20 which is erected downstream of a fully automatically working washing machine 21 (only FIG. 1). The washing is discharged in a flushing manner from the washing machine 21, from its outlet connection 22, in the form of an initially very loose washing mass 23. The washing mass 23 is guided via a guide channel 24 to the water-removal press 20. In the guide channel 24, the actual channel part 25 is closed by a funnel part 26, the walls of which are, however, largely made in the shape of a circular cylinder. The washing mass 23, after the water is removed by the water-removal press, is later pushed (FIG. 10) by means of a slide 27 onto a conveyor belt 28 adjoining the water-removal press 20 and conveyed by the conveyor belt 28 to further treatment stations, such as, washing driers, mangle machines and the like.

The water-removal press 20 has a machine framework 30 which comprises four disk-shaped yoke frames 31 to 34. Each of these yoke frames includes a pedestal 35, two side walls 36 and 37 and a yoke 38 which are firmly combined with one another into the closed yoke frame (FIG. 2). The yoke frames, in the area of their pedestal, are combined with one another non-detachably to the machine framework 30 by three continuous pedestal webs 39, and, in the area of their yokes, by three groups of, in each case, four yoke webs 41, and, in fact, are welded to one another.

A press base 42 sits on the pedestals 35 of the four yoke frames 31 to 34. The press base 42 is provided with numerous discharge openings 43, through which the water emerging from the washing mass 23 can flow into the collecting container 44 arranged beneath the press base 42. This collecting container 44, at the same time, surrounds the pedestals 35 of the yoke frame 31 to 34.

A circular-cylindrical filling frame 45 is arranged in the inner space of the machine framework 30. It is open at both end faces and has a smooth inside wall of a certain clearance width. In the intermediate space between the two center yoke frames 32 and 33, the filling frame 45 is connected in each case to a guide arm 46 and 47, respectively, by means of which it is displaceably guided in the vertical direction in each case on one guide column 48 and 49, respectively.

A lifting device 50 having two piston drives 51 and 52 is available for the vertical adjustment of the filling frame 45. Their operating cylinders 53 and 54 are detachably fixed to the adjacent yoke frames 32 and 33. Their piston rod 55 and 56 is connected to the guide arm 46 and 47, respectively, of the filling frame 45. By means of this lifting device 50, the filling frame 45 can be lowered onto the press base 42 (FIGS. 1 to 6) or raised into a certain vertical position (FIGS. 7 to 10).

In the inner space of the machine framework 30, a press piston 60 is arranged on a bearer plate 57 by means of several distance bodies 58. The bearer plate 57 is guided by means of two guide arms 61 and 62 on the same guide columns 48 and 49, on which the filling frame 45 is also guided by means of the guide arms 46 and 47. Thus, the press piston is displaceably guided in alignment with the filling frame 45. A separate lifting device 63 is available for the press piston 60. The lifting device 63 is designed as a pneumatically operating piston drive 64. Its operating cylinder sits on the yokes 38 of the two center yoke frames 32 and 33 and on the two yoke webs 71 located in the center, and is detachably connected to these parts. The piston rod 66 is connected to the bearer plate 57.

Figure 11:
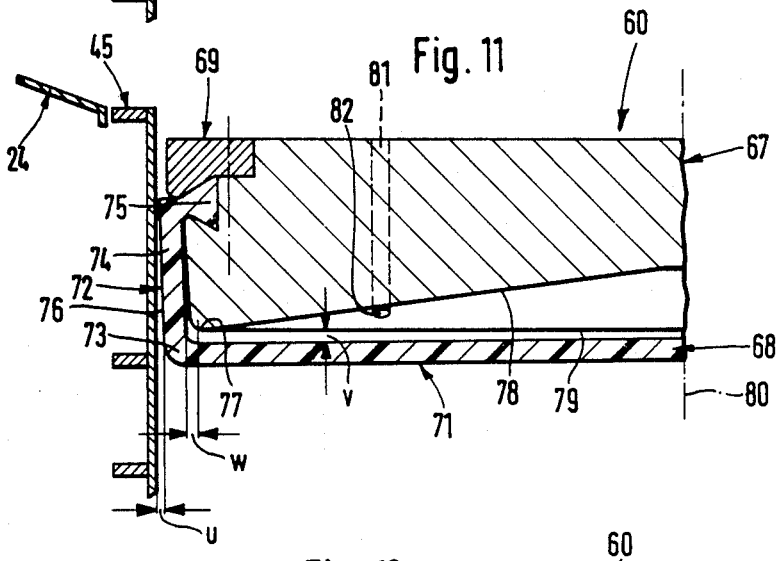
FIG. 11 shows a sectionally represented cross-section of some parts of the water-removal press in the non-operating condition.

The press piston 60 is made in several parts. It has a rigid piston body 67 of metal, a rubber-elastic, pot-shaped diaphragm 68 and a rigid, metal clamping ring 69. FIG. 11, which shows the pot-shaped diaphragm 68 in the stress-free condition, as it originates in the manufactured form, clearly shows the parts of the press piston 60 in their geometric configuration and in their mutual allocation.

The pot-shaped diaphragm 68 is made from a highly elastic material, for example, from an alkali-resistant synthetic rubber. It has a flat base part 71 and a circular-cylindrical collar part 72 which adjoin one another without transition. The cross-section profile at the transition area 73 between the flat base part and the collar part is rounded off in a curved shape. The base part 71 and the collar part 72, just as the transition area 73, have at least approximately uniform wall thickness. A radially inwardly directed fastening bead 75 is integrally formed on the free edge 74 of the collar part 72. The fastening bead 75 clamps the pot-shaped diaphragm 68 to the piston body 67 by means of the clamping ring 69 and, at the same time, fixes the pot-shaped diaphragm fluid-tight. The fastening bead 75 has a symmetric trapezoidal or dovetail-shaped cross-section shape, the height of which increases from the outer edge toward the inner edge.

The collar part 72 of the pot-shaped diaphragm 68, in the stress-free condition (FIG. 11), has an outside diameter which is smaller than the clearance width of the filling frame 45 by a certain size "u". The piston body 67 has a peripheral surface 76, the axial height of which is smaller than the clearance height of the collar part 72 between the base part 71 and the fastening bead 75 by the size "v". The peripheral surface 76 of the piston body 67 is a conical envelope surface. Its greatest diameter, even at the transition area of the collar part 72 to the fastening bead 75, is, at maximum, equal to the clearance width of the collar part 72, the clearance width being measured in the same cross-section plane. Expediently, it is even smaller, so that the fastening bead 75 can be put on more easily. From this point, the undersize of the outside diameter of the peripheral surface 76 increases constantly relative to the clearance width of the collar part 72, up to a maximum value "w" in the area of the rounded-off piston edge 77.

The end face 78 of the piston body 67, relative to reference plane 79 which is in contact against the encircling piston edge 77, is made hollow in such a way that its distance from this reference plane 79 increases constantly up to a maximum value from the rounded-off piston edge 77 to the center line 80. At the center line 80, the surface normal of the end face 78 is aligned parallel to the center line 80.

The piston body 67 is provided with at least one axial throughhole 81, the mouth 82 of which is located in the end face 78. On the outer side of the piston body 67, a connecting line 83 (FIG. 1) of a filling and emptying device 84 is connected to the throughhole 81. The connecting line 83 is not shown in FIG. 11. Pertaining to this, filling and emptying device 84, inter alia, is a delivery pump 85 having a high volumetric delivery for filling and emptying the intermediate space between the piston body 67 and the pot-shaped diaphragm 68 of the press piston 60, and a pressure pump 86 for producing a high overpressure in this intermediate space of the press piston 60. The suction line 87 of both pumps is connected to the collecting container 44 for the discharged water which is, therefore, first used for the operation of the water-removal press before it is resupplied to the washing and rinsing operations in the washing machine 21.

Figure 12:
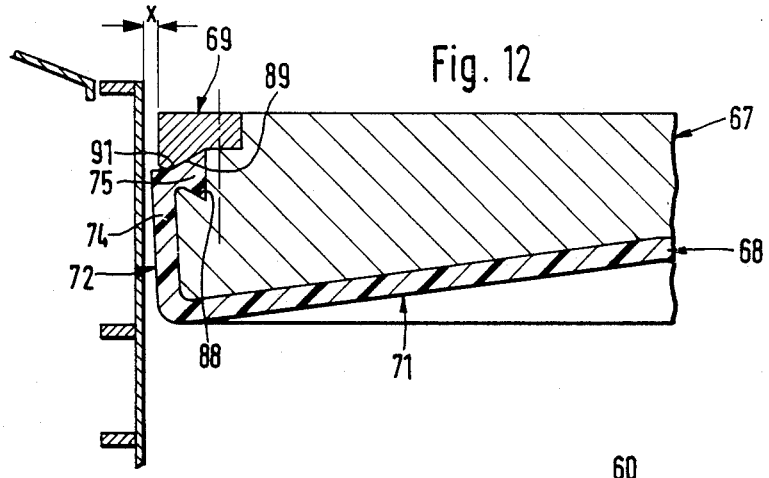
FIG. 12 shows a cross-section, similar to FIG. 11, in a first operating condition.

A seating surface 88 (FIG. 12) is present on the piston body 67 on the side facing away from the end face 78. The seating surface 88 is adapted to the cross-section shape of the stress-free fastening bead 75. A seating surface 89 is likewise present on the clamping ring 69 on the side facing toward the fastening bead 75. The seating surface 89 is adapted to the cross-section shape of the fastening bead. On the clamping ring 69, a supporting edge 91 adjoins this seating surface 89 in a radially outward direction. The supporting edge 91 is adapted to the cross-section shape of the edge 74 of the collar part 72 in order to support the collar part 72 in the axial direction. The outside diameter of the supporting edge 91 is smaller than the clearance width of the filling frame 45 by a certain size "x". This undersize "x" is expediently selected slightly larger than the undersize "u" of the stress-free collar part 72 relative to the filling frame 45, so that textile parts which move by chance into the annular gap between the filling frame 45 and the press piston 60 cannot be crushed between the metal filling frame 45 and the metal clamping ring 69.

Figure 6:
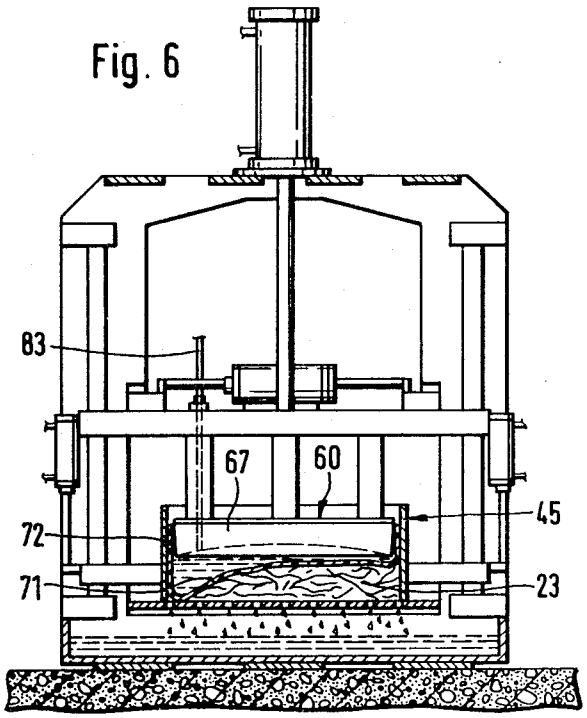
FIG. 6 shows a vertical section, similar to FIG. 2, in a fourth operating condition.
Figure 5:
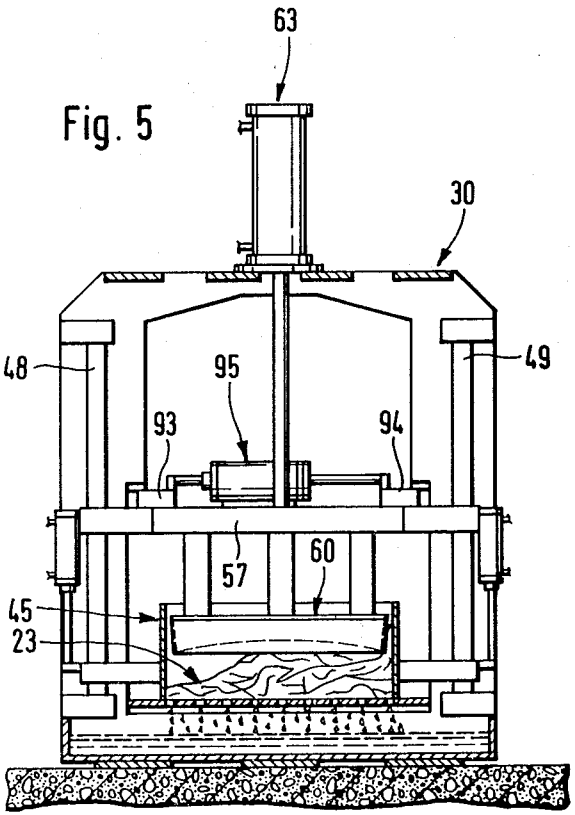
FIG. 5 shows a vertical section, similar to FIG. 2, in a third operating condition.
Figure 8:
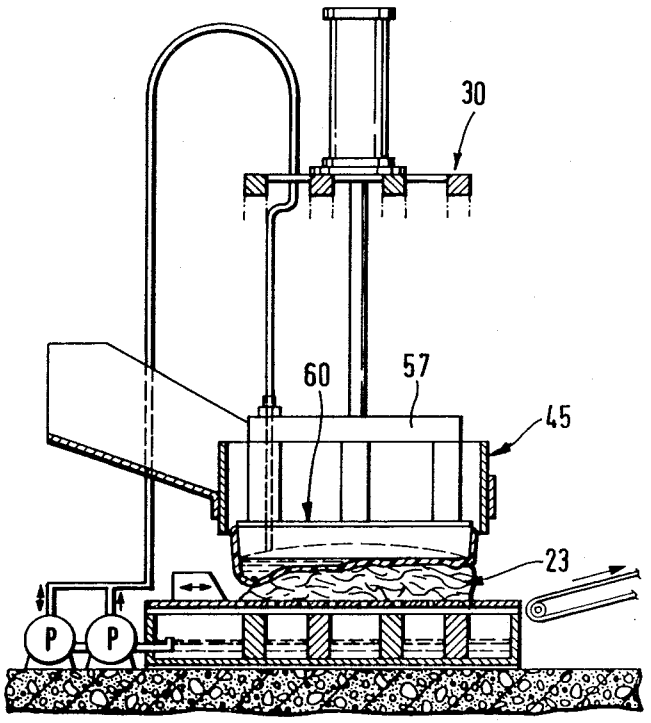
FIG. 8 shows a vertical section, similar to FIG. 1, in a fifth operating condition.

A locking device is available for the press piston 60. The locking device locks the press piston 60 in its operating position (FIGS. 5 and 6) relative to the machine framework 30 so that its lifting device 63 is relieved of the axial press forces. Pertaining to the locking device 92 are two locking bars 93 and 94 which are displaceably guided in the radial direction on the upper side of the bearer plate 57 and are coupled to a piston drive 95 in such a way that the operating cylinder 96 is connected to the one locking bar 94 and the piston rod 97 is connected to the other locking bar 93. As further parts of the locking device 92, steps 98 and 99, respectively, are available on the machine framework 30, and, in fact, in each case on the two side wall parts 36 and 37. The steps 98 and 99 are adapted to the locking bars 93 and 94 such that, in the operating position of the press piston 60, the locking bars 93 and 94 can be pushed by their piston drive 95 beneath the steps 98 and 99 (FIGS. 5 and 6). Consequently, the reaction forces of the press piston 60 can be supported directly on the machine framework 30 via the bearer plate 57 and the locking bars 93 and 94.

The operating method of the water-removal press is described below.

Figure 4:
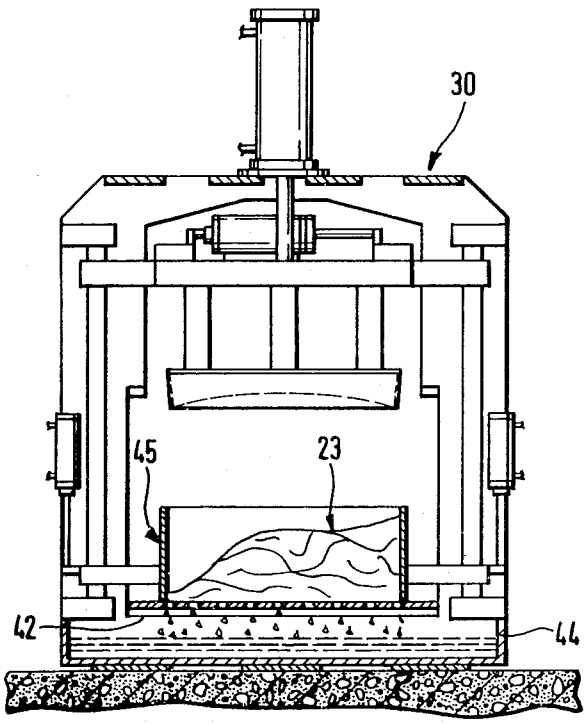
FIG. 4 shows a vertical section, similar to FIG. 2, in the second operating condition.
Figure 3:
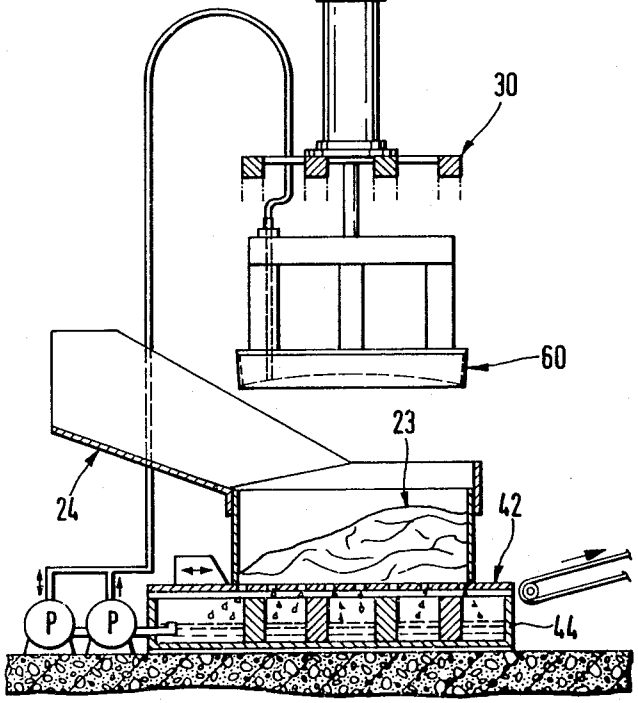
FIG. 3 shows a vertical section, similar to FIG. 1, in a second operating condition.

When the filling frame 45 is lowered and the press piston 60 raised (FIGS. 1 and 2), a washing batch is transferred from the washing machine 21 into the filling frame 45 via the guide channel 24. Since the washing is still mixed with a great deal of water from the final rinsing operation, it is virtually flushed into the filling frame 45. The frictional forces inside such a washing mass 23 are of varying size depending on the type of textiles. In the case of textiles made of synthetic fibers, the internal friction is comparatively low, for which reason such a washing mass is distributed comparatively uniformly in the filling frame 45. In the case of textiles made of cotton or having a high proportion of cotton, the internal friction in the washing mass is comparatively high. In such textiles, therefore, there is always the tendency for the washing mass 23 to pile up on the wall of the filling frame 45, which wall is opposite the guide channel 24 (FIG. 3). Since the textiles are generally flushed out of the running motion of the drum of the washing machine 21 with a certain angular momentum onto the guide channel 24 and from there into the filling frame 45, the washing mass 23 generally also piles up on one side in the filling frame 45 transversely to its insertion direction (FIG. 4). In the case of very antistatic textiles, this difference in height usually somewhat balances itself out. In the case of less antistatic textiles, the washing mass 23 is left behind in the filling frame 45 in this double one-sided arrangement.

During the flushing-in and during the first period of disposition of the washing mass 23 in the filling frame 43, a large proportion of the water conducted along with the washing mass 23 is already discharging through the discharge openings in the press base 42 into the collecting container 44 (FIG. 4). The bearer plate 57 on the guide columns 48 and 49 is lowered by means of the lifting device 63 into the operating position or press position. During this procedure, the press piston 60 plunges into the filling frame 45 to a certain depth (FIG. 5). Insofar as the washing mass 23 rises further beforehand, it is compressed to this insertion depth of the end face 78 of the piston body 67. Consequently, a further proportion of the water is pressed out of the press mass 23. When the press piston 60 plunges into the filling frame 45, there is an adequately wide annular gap between these two parts, which annular gap avoids such textile parts which have gotten caught on the edge of the filling frame 45 or which have been thrust up slightly between the press frame 45 or which have been thrust up slightly between the press piston 60 as is indicated on the right-hand side in FIG. 5, from becoming jammed or even crushed between these two parts.

Figure 13:
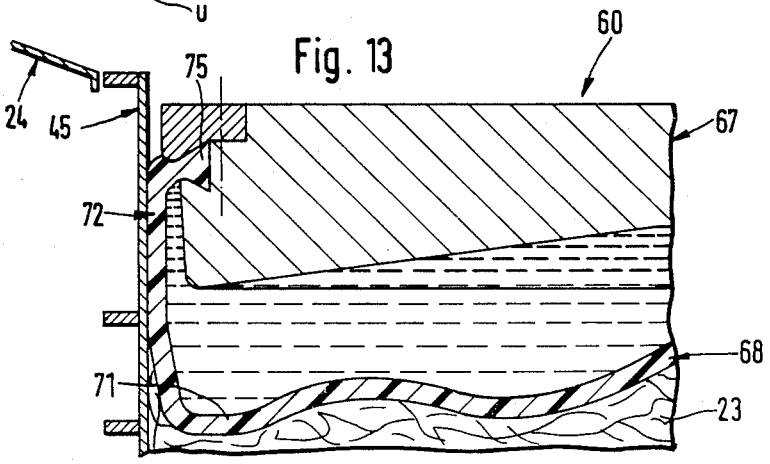
FIG. 13 shows a cross-section, similar to FIG. 11, in a second operating condition.

When the bearer plate 57 with the press piston 60 has reached the operating position or press position (FIG. 5), the two locking bars 93 and 94 are displaced radially outward by means of the transversely located piston drive 95 into their locking position, in which they grip beneath the steps 98 and 99 on the machine framework 30 (FIG. 6) and thus lock the bearer plate 57 together with the press piston 60 in the vertical direction. Water is thrust as a pressure medium by the two pumps 85 and 86, working in parallel, via the connecting line 83 into the intermediate space between the piston body 67 and the pot-shaped diaphragm 68. Consequently, the collar part 72 of the pot-shaped diaphragm 68, starting from the fixing bead 75, comes in contact against the inner wall of the filling frame 45 and seals the annular gap toward the top between the press piston 60 and the filling frame 45 (FIG. 13). Inasmuch as the fixing bead 75 is at the same time drawn outward and stretched radially, the wedge shape or dovetail shape of its cross-section compensates for this elastic deformation. With increasing filling action of the inner space of the pot-shaped diaphragm 68, its base part 71 is pressed downward to an increasing extent against the washing mass 23, with, of course, contact first taking place on those parts of the washing mass 23 which were closest to the non-extended diaphragm. During this extension movement of the pot-shaped diaphragm 68, all parts of the washing mass 23 are finally reached as the filling action advances (FIG. 6).

When the filling action is largely complete, the delivery pump 85 is switched off and the pressure pump 86 continues to work on its own. This then delivers only a small quantity of the pressure medium at an applied pressure of about 40 bar. Under this very high applied pressure which acts to the maximum extent on the washing mass 23 because of the elasticity of the pot-shaped diaphragm 68, the remaining water in the washing mass is pressed out of the latter to the greatest extent, with it discharging to the collecting container 44 through the discharge openings in the press base 42.

When the washing mass 23 has been pressed out sufficiently, the pressure pump 86 is switched off and the delivery pump 85 is switched on with reversed delivery direction for emptying the hollow space of the piston. The pot-shaped diaphragm 68 increasingly draws together to the extent to which the pressure medium is delivered out of the hollow space of the piston. At the same time, the collar part 72 of the pot-shaped diaphragm 68 withdraws from the filling frame 45, so that an annular gap is again free between the press piston 60 and the filling frame 45. The base part 71 of the pot-shaped diaphragm then sits still partially against the pressed washing mass 23, and in fact against the parts which project up the highest, with it withdrawing to an increasingly greater extent as the emptying action advances.

As soon as the collar part 72 of the pot-shaped diaphragm is withdrawn to an adequate extent from the filling frame 45, the filling frame 45 is raised into its maximum vertical position on the guide columns 48 and 49 by means of the piston drives 51 and 52 (FIG. 7), in which position it is just below the bearer plate 57 or, at most, is in contact against the latter. During this lifting movement of the filling frame 45, the press piston 60 stops in its operating position.

At the same time, the press piston 60 acts as a holding-down device which prevents the washing mass 23 from being raised with the filling frame 45. The latter occurrence depends, of course, on the original arrangement of the textile parts of the washing mass 23 and their mechanical behavior when being pressed out. Under certain of these conditions, some parts of the washing mass 23 are more or less thrust diametrically outward to the extent that they sit comparatively tightly against the filling frame 45 and consequently a certain adhesion is present between the washing mass 23 and the filling frame 45. From this movement sequence of the filling frame 45 relative to the press piston 60, it becomes clear why the press piston 60 cannot be arranged directly on the guide plate 57, but has to be arranged at a distance from the filling frame 45 by precisely this lift of the filling frame 45 by means of the distance bodies 58.

The function of the press piston 60 as a holding-down device is unnecessary at the latest when the filling frame 45 has been completely raised. Its intermediate space between the pot-shaped diaphragm 68 and piston body 67 is not only completely emptied by the pressure medium, but a vacuum is even produced in the hollow space by the delivery pump 85. As a result of the pressure difference, the pot-shaped diaphragm 68 is pressed against the outer side of the piston body 67, as can be seen from FIG. 12.

Figure 7:
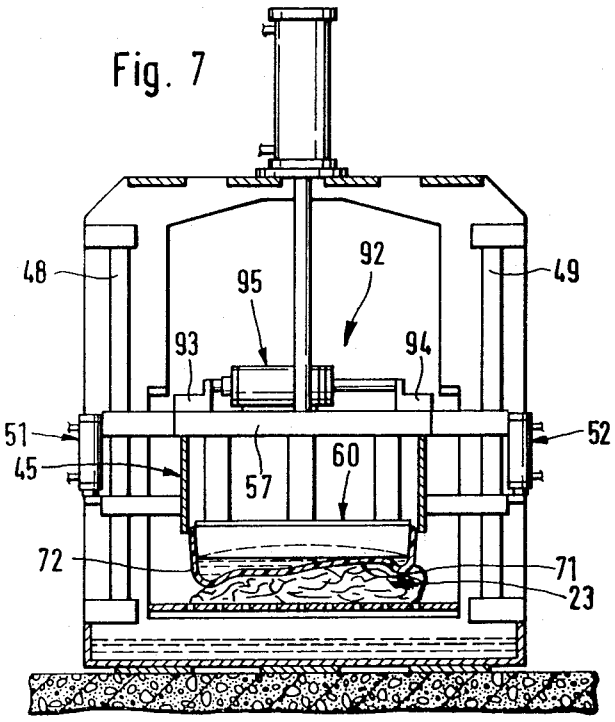
FIG. 7 shows a vertical section, similar to FIG. 2, in a fifth operating condition.
Figure 9:
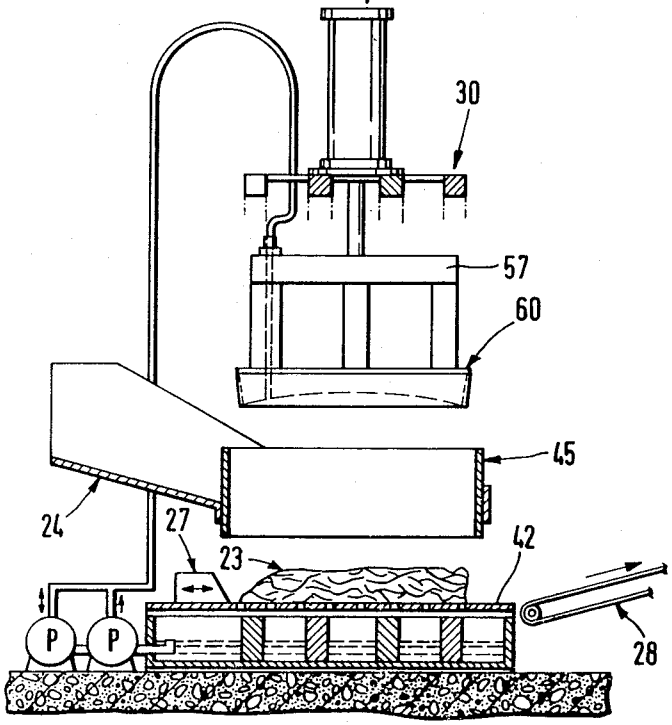
FIG. 9 shows a vertical section, similar to FIG. 1, in a sixth operating condition.

The locking device 92 of the press piston 60 is released, at the latest, after the end of the lifting movement of the filling frame 45. The two locking bars 93 and 94 are withdrawn from their locking position into their release position by means of the piston drive 95 (FIG. 7). The bearer plate 57 with the press piston 60 is raised into its non-operating or initial position by means of the lifting device 63 (FIG. 9). The pressed-out washing mass 23 is now exposed on the press base 42. It can now be pushed by means of the slide 27 from the press base 42 to the conveyor belt 28 (FIG. 10), and then conveyed from the latter to the further treatment stations.

Figure 14:
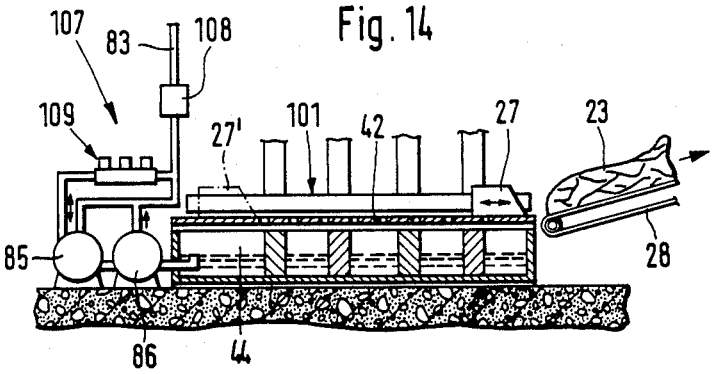
FIG. 14 shows a vertical section of the water removal press detailing the pressure regulation system and slide.
Figure 15:
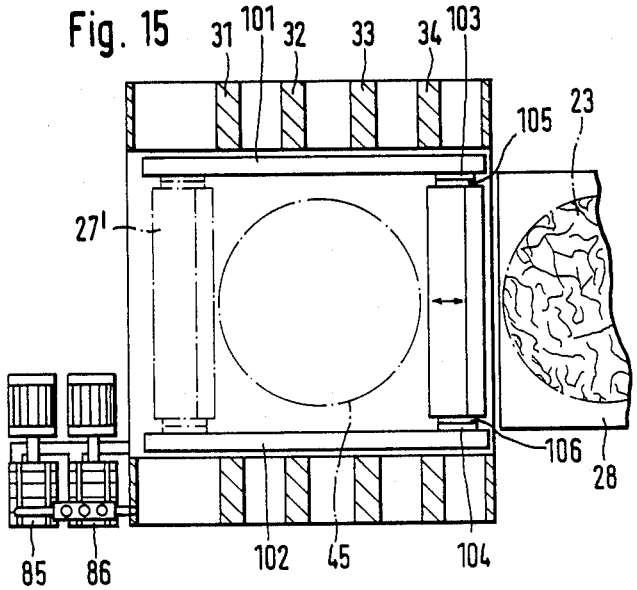
FIG. 15 shows a horizontal section of the water-removal press according to FIG. 14.

A few details of the slide 27 and its drive can be seen from FIGS. 14 and 15. The slide 27 is in the form of a ledge with a trapezoidal side elevation, the parallel sides of which are aligned parallel with the press floor 40. The wall surface facing the washing mass 23 is slightly inclined to the vertical, upwards and backwards.

Two pneumatic drives 101 and 102 are present as a drive for the slide 27. The drives are arranged on the press floor 28, within the yoke frames 31–34 of the machine frame. They lie outside the stationing region of the filling frame 45, shown in dashed lines in FIG. 15, and are aligned parallel to the direction of displacement of the slide 27.

Neither the piston drive 101 or 102 has a piston rod. Instead, the piston is connected to a piston yoke 103 or 104, respectively, which projects laterally, in a radial direction, from the cylinder of the piston drive through a slotted hole (not shown) of this cylinder. This slotted hole is sealed by means of two sealing strips. A coupling element 105 or 106, respectively, is suitably coupled to each piston yoke 103 and 104, and, to the extent possible, only transmits such forces as are aligned parallel to the long axis of the piston drives 101 and 102, and, to the extent possible avoids the foces aligned transversely of these, in particularly perpendicularly of the press floor 28. The coupling elements 105 and 106 are firmly connected to the slide 27.

Both piston drives 101 and 102 have a length such that they do not, to the extent possible, project beyond the base frame. In addition, the drives position the slide 27, sufficiently far outside the stationing region of the filling frame 45, as depicted by reference 27' shown in broken lines, yet provide for displacement as shown in solid lines in FIG. 15, of the slide 27 with its front side reaching as far as possible onto the conveyor belt 28.

As soon as the washing mass 23 has been pushed from the press floor 42 and the slide 27 has returned to its original position, the filling frame 45 is lowered again to the press floor 42 by means of the lifting device 50 with the two piston drives 51 and 52. Thus the initial position of the parts, as in FIGS. 1 and 2, is regained, and washing can be again transferred from the washing machine 21 into the water-removal press 20.

Figure 16:
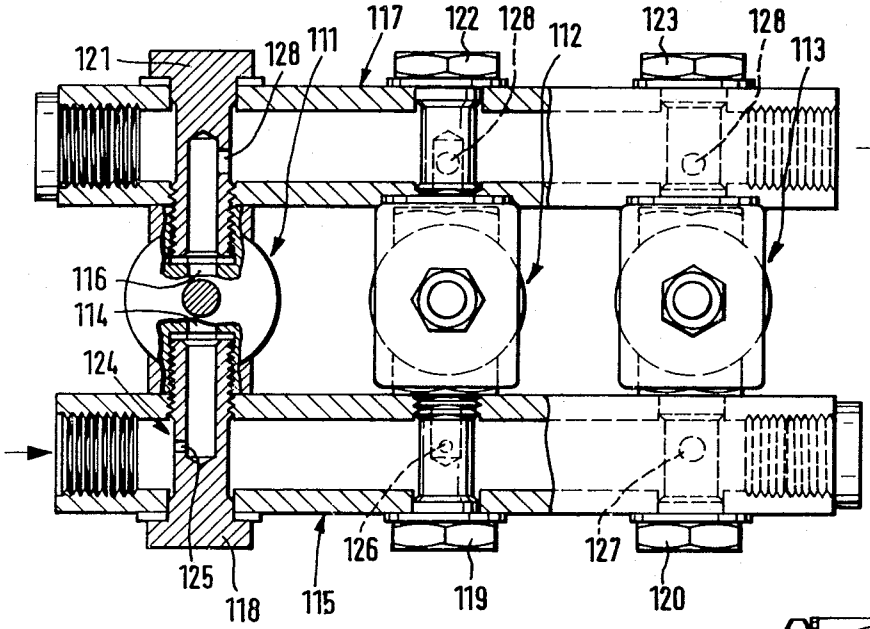
FIG. 16 shows a plan view, partially cut away, of a part of the pressure regulating system of a water-removal press.
Figure 17:
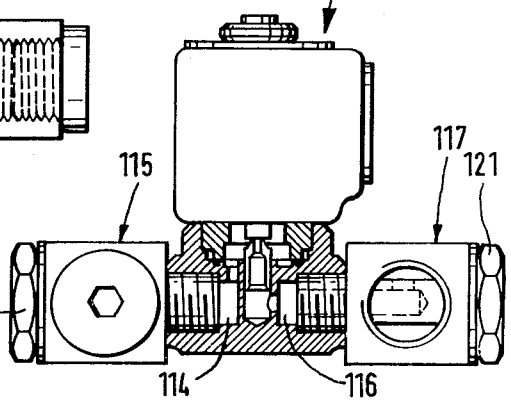
FIG. 17 shows a front view, partially cut away, of the part of the pressure regulating system according to FIG. 16.

A pressure controller is shown in FIG. 14 for the working pressure of the working medium, which is injected via the connecting duct 83 into the intermediate space between the diaphragm 68 and the piston body 67 (FIGS. 6–8 and FIG. 13). A pressure sensor 108 forms a part of the pressure controller 107 and is inserted along the connecting duct 83 which opens into the intermediate space of the diaphragm 68, and which functions as the pressure duct in this case. A bypass 109 branches off the connecting duct 83 before the pressure sensor 108 and opens into the supply container 44 of the two pumps 85 and 86 or at least into the intake duct of the pressure pump 86. Apart from this, the pressure controller 107 also possesses a control system, not shown in detail, with a selector device for different pressure levels, with a vibrator and a comparator circuit. Three magnetic valves 111–113 are present in the bypass 109 as further parts of the pressure control system (FIGS. 16 and 17). The three magnetic valves 111–113 are mutually connected in parallel. Their inlet openings 114, which can be seen in FIG. 16, on the magnetic valve 11, are connected to a common distributor body 115, which is connected to the connecting duct 83. The outlet opening 116 is connected to a collecting body 117, which is common to all the magnetic valves. The connection between each of the magnetic valves 111–113 and the distributor body 115 is effected via a respective hollow screw 118, 119 or 120 for each valve, the screws being respectively inserted through a pair of aligned passage holes in the collecting body and screwed into the corresponding thread in the valve body of the magnetic valve. Similarly, the magnetic valves 111–113 are each connected by a hollow screw 121, 122 or 123 to the collecting body 117, which is connected in turn to the outlet duct from the bypass 109 to the supply container 44.

A respective throttle point 124 is arranged in front of the inlet opening 114 of each of the magnetic valves. It is formed by a throttle bore 125 which connects the internal cavity of the hollow screw 118 with the cavity of the collecting body 115. This throttle bore 125 in the hollow screw 118 has a certain passage cross section. The throttle bore 126 in the hollow screw 119 has another, and in fact somewhat greater, passage cross section. The throttle bore 127 in the hollow screw 120 likewise has another, in fact still greater, passage cross section than the two other throttle bores 125 and 126. The crossbore 128 is of equal size on the outlet side of the magnetic valves, in the hollow screws 121–123, and its passage cross section is at least equal to, or even somewhat greater than, the greatest passage cross section of the hollow screws on the inlet side of the magnetic valves.

In the operation of the washing press, the pressure pump 86 driven by its drive motor with constant rotational speed delivers a maximum operating pressure of the working medium of, for example, 40 bar. If this maximum operating pressure would be too high for one or other kind of textile, so that this could then be creased and/or splits could occur in the fabric, a lower pressure level is set on the selector device according to the sensitivity of the textiles. The vibrator switches the signal output of the selector device and the signal output of the pressure sensor 108, at regular, very short intervals, to the comparator circuit, which produces from the two input signals an actuating signal for the magnetic valves 111–113. According to the magnitude of the pressure level set on the selector device and the actual pressure in the connecting duct 83, one or more of the magnetic valves is briefly, cyclically opened by the pressure reegulating system, so that a well-defined pressure drop is produced at the throttle point to reduce the pressure in the connecting duct 83 to the desired pressure value and holds it at this pressure value. If the diameters of the throttle bores 125–127 in the hollow screws 118–120 are, for example, graduated at 1.5 mm, 2.5 mm and 2.8 mm, pressure levels with the pressure values of 36 bar, 31 bar, 28 bar, 26 bar, 24 bar, 21 bar and 18 bar can be achieved and maintained relatively accurately by the programmed switching in of the magnetic valves in the following numerical selection: 1, 2, 3, 1+2, 1+3, 2+3, and 1+2+3.

Instead of this digital pressure regulation, the pressure regulation of the working medium can also be carried out with a pressure control valve operating in an analog manner. Since, however, intermediate values would also always have to be sensitively set, this type of pressure regulation is found in practice to be somewhat subject to trouble.

What is claimed is:

1. A water-removal press for textiles, comprising:

a machine framework;

a press base which includes a plurality of discharge openings;

a circular-cylindrical filling frame, said filling frame being open at both end faces displaceably guidable on perpendicularly aligned guides, and capable of being lowered onto said press base and vertically positioned by means of a lifting device;

a press piston comprising a circular, rigid piston body having a free end face, a pot-shaped elastic body fixed to said piston body along an edge area, and an intermediate space between said piston body and said elastic body for receiving a fluid, said piston being displaceably guided in alignment with said filling frame by means of a perpendicularly aligned guide, and vertically positionable by means of a lifting device, wherein said elastic body comprises a pot-shaped diaphragm which includes a base part, a circular-cylindrical collar part which adjoins said base part without transition, said base part being flat in the stress-free condition and being adapted to face said free end face of said piston body, and an inwardly directed fastening bead integrally formed on an open edge of said collar part, a lower edge of said fastening bead being adapted to sit on a seating surface of said piston body;

a clamping ring arranged on the side of said fastening bead facing away from said base part, said ring including a seating surface contacting said fastening bead, said clamping ring being connected to said piston body in the axial direction;

a filling and emptying means which includes a delivery pump and a pressure pump, for filling and emptying said intermediate space;

means for drawing said collar part of said diaphragm radially inwardly against said piston body so that said collar part has an outside diameter smaller than the clearance width of said filling frame, wherein:

said piston body is dimensioned such that the outside diameter of its peripheral, radially outwardly facing surface increases from a point nearest said base of said diaphragm toward said seating surface and such that said outside diameter of said piston body is less than the outside diameter of said collar part, said piston body is further dimensioned such that the axial length between said seating surface and said point nearest said base of said diaphragm is less than the axial length between said fastening bead of said diaphragm and said base, and, said free end face of said piston body is dimensioned such that it is concave relative to said base of said diaphragm, whereby, when said filling and emptying means is operated to empty said intermediate space, said collar part of said diaphragm is drawn radially inwardly against said piston body so that the clearance between said collar part and said filling frame is increased and the risk that textiles will become jammed between said filling frame and said collar part is reduced.

2. A water-removable press as claimed in claim 1, wherein said fastening bead increases in height in the direction inward of the peripheral edge of said piston body.

3. A water-removable press as claimed in claim 2, wherein said fastening bead has a dovetail cross-section.

4. A water-removable press as claimed in claim 2, wherein said seating surface of said piston body and said seating surface of said clamping ring are adapted to intergrally contact said fastening bead in the stress-free condition.

5. A water-removable press as claimed in claim 1, wherein said clamping ring further includes a supporting edge along the outer periphery of said seating surface.

6. A water-removable press as claimed in claim 5, wherein the outside diameter of said clamping ring is smaller than the outside diameter of said collar part of said diaphragm.

7. A water-removable press as claimed in claim 1 further comprising a locking device for locking said press piston in the press position.

8. A water-removable press as claimed in claim 7, wherein said locking device is positioned partially on said press piston and partially on said machine framework.

9. A water-removable press as claimed in claim 7, wherein said locking device is positioned partially on a part connected to said press piston and partially on said machine framework.

10. A water-removable press as claimed in claim 7, wherein said locking device is positioned on first and second part connected to said machine framework.

11. A water-removal press as claimed in claim 1, further comprising a slide displaceably guided along said press base from a region on side of said filling frame to the opposite side of said filling frame, and a pair of pneumatic piston drives positioned on either side of said filling frame and in parallel to the path of displacement of said slide.

12. A water-removal press comprising:

a machine framework;

a press base which includes a plurality of discharge openings;

a circular-cylindrical filling frame, said filling frame being open at both end faces displaceably guidable on perpendicularly aligned guides, and capable of being lowered onto said press base and vertically positioned by means of a lifting device;

a press piston comprising a circular, rigid piston body, a pot-shaped elastic body fixed to said piston body along an edge area, and an intermediate space between said piston body and said elastic body for receiving a fluid, said piston being displaceably guided in alignment with said filling frame by means of a perpendicularly aligned guide, and vertically positionable by means of a lifting device, wherein said elastic body comprises a pot-shaped diaphragm which includes a base part, a circular-cylindrical collar part which adjoins said base part without transition, said base part being flat in the stress-free condition, and an inwardly directed fastening bead integrally formed on the open edge of said collar part, the lower edge of said fastening bead being adapted to sit on a seating surface of said piston body;

a clamping ring arranged on the side of said fastening bead facing away from said base part, said ring including a seating surface contacting said fastening bead, said clamping ring being connected to said piston body in the axial direction;

a filling and emptying means which includes a delivery pump and a pressure pump, for filling and emptying said intermediate space;

wherein said collar part of said diaphragm, in the stress-free condition, has an outside diameter smaller than the clearance width of said filling frame, the peripheral surface between the end-face seating surface of said fastening bead and its free end face is shorter than the axial clearance distance between said base part and said fastening bead, and the outside diameter of the peripheral surface of said piston body is smaller than the clearance width, measured in the same plane, of said collar part, and wherein said free end of the piston body is at least partially hollow relative to a reference plane in contact with said free end face.

a connecting duct between said pressure pump and said intermediate space of said press piston, a pressor sensor positioned in said connecting duct for producing control signals dependent on the pressure in said connecting duct, a supply container for receiving and dispensing said fluid, a bypass connected to said connecting duct and opening into said supply container, a plurality of magnetic valves arranged along said bypass and comprising inlet openings connected in parallel to said connecting duct and outlet openings connected in parallel to said supply container, each of said valves further including a throttle point upstream of said inlet opening, wherein the cross section of the passage of each throttle point is different, and a control system for varying the pressure level, comprising a vibrator and a comparator circuit.

13. A water-removal press as claimed in claim 12, wherein said throttle point comprises a hollow screw which includes a throttle bore.

14. A water-removal press as claimed in claim 12, wherein said throttle point comprises a throttle stop inserted in said inlet openings.

* * * * *